US005446945A

United States Patent [19]

Hachenberger

[11] Patent Number: 5,446,945

[45] Date of Patent: Sep. 5, 1995

[54] WASTE REMOVAL SYSTEM FOR PROCESSING ANIMAL FIBERS

[76] Inventor: Steven C. Hachenberger, 894 Pheasant Run, Hamilton, Mont. 59840

[21] Appl. No.: 223,170

[22] Filed: Apr. 5, 1994

[51] Int. Cl.[6] ..... D01G 15/04; D01B 9/00

[52] U.S. Cl. ..... 19/107; 19/99; 19/100

[58] Field of Search ..... 19/2, 107, 108, 99, 19/100, 115 A, 128

[56] References Cited

U.S. PATENT DOCUMENTS

| | | | |
|---|---|---|---|
| 427 | 10/1837 | Wolcot et al. | 19/99 |
| 12,469 | 2/1855 | Gambrill et al. | 19/100 |
| 16,196 | 12/1856 | Walton | 19/108 |
| 2,560,013 | 7/1951 | Varga | 19/100 |
| 4,434,531 | 3/1984 | Mondini | 19/99 |
| 4,642,850 | 2/1987 | Giuliani | 19/105 |

FOREIGN PATENT DOCUMENTS

| | | |
|---|---|---|
| 2617063 | 6/1987 | France . |
| 3612899A1 | 10/1986 | Germany . |
| 626713 | 7/1949 | United Kingdom . |
| 1706509A1 | 10/1988 | U.S.S.R. . |

*Primary Examiner*—John J. Calvert
*Attorney, Agent, or Firm*—Nilsson, Wurst & Green

[57] ABSTRACT

A dehairing system with rotating cylinders bearing tines is provided to dehair fibers by forces, including centrifugal force. The dehairing system may include multiple dehairing units forming a dehairing processing line such that fibers for dehairing may be transferred upstream and downstream for extended dehairing. Each dehairing unit includes cylinders rotating at different and varying rotational speeds for transferring fibers between the cylinders, as well as between the units. A motor unit may be provided for rotating various cylinders such that they may impart rotation to other selected cylinders for accomplishing dehairing. Having different lengths and extending at different angles, the tines provided on the cylinders facilitate a brushing and/or flicking action for expelling contaminants.

24 Claims, 4 Drawing Sheets

WASTE REMOVAL SYSTEM FOR PROCESSING ANIMAL FIBERS

FIELD OF THE INVENTION

This invention relates to the field of dehairing fibers. In particular, this invention relates to a dehairing system using rotating cylinders bearing tines for extracting contaminants such as guardhairs from raw fibers.

BACKGROUND AND SUMMARY OF THE INVENTION

Fibers such as wools have long been used for manufacturing fabrics and textiles. These fibers in raw form require substantial processing, including cleaning and removal of undesirable matter, such as burrs, foxtails and the like, for placing the fibers in a workable form. As a related consideration, guardhairs of certain wools (like cashmere) must be removed or otherwise separated from workable fibers before the workable fibers can be manufactured into fabrics and the like. Essentially, guardhairs are coarse or stiff hairs grown by certain animals along with workable wool fibers.

Systems are known for carding and/or cleaning wools. Not only are these systems somewhat complex, but they can pellet, curl, and even shred various wools like cashmere or cashmere blends. Consequently, many, and particularly those in the cashmere processing industry, have resorted to manual techniques for sorting and removing contaminants or unwanted matter. Obviously, such manual techniques are labor-intensive and thus cost-intensive. With recent increased appreciation and demand of cashmere fabrics and textiles, there exists a need for a dehairing system that efficiently and effectively removes contaminants, including guardhairs from raw fibers.

Recognizing the need for an efficient and effective dehairing system, the present dehairing system is relatively simple in structure and circumvents substantial manual labor with minimal damage to workable fibers. The present system provides a dehairing unit having rotating cylinders bearing tines to dehair fibers. By providing different and varying rotational speeds, the dehairing unit transfers the fibers between the cylinders for dehairing by forces, including centrifugal force. To further accomplish dehairing, the cylinders rotate in opposite directions, facilitated by tines of different lengths and extending at different predetermined angles from the cylinder.

Moreover, where multiple dehairing units are positioned adjacent to form a dehairing process line, the units interact cooperatively to transfer fibers therebetween for dehairing. In particular, the cylinders rotating at different and varying rotational speeds transfer the fibers up and down the dehairing process line, between the units, for extended dehairing.

These, as well as other features of the invention, will become apparent from the detailed description which follows, considered together with the appended drawings.

DESCRIPTIONS OF THE DRAWINGS

In the drawings, which constitute a part of this specification, exemplary embodiments demonstrating various objects and features hereof are set forth as follows.

DESCRIPTION OF THE ILLUSTRATIVE EMBODIMENTS

As indicated above, detailed illustrative embodiments are disclosed herein. However, systems for accomplishing the objectives of the present invention may be detailed quite differently from the disclosed embodiments. Consequently, specific structural and functional details disclosed herein are merely representative; yet, in that regard, they are deemed to afford the best embodiments for purposes of disclosure and to provide a basis for the claims herein which define the scope of the present invention.

Figure 1:
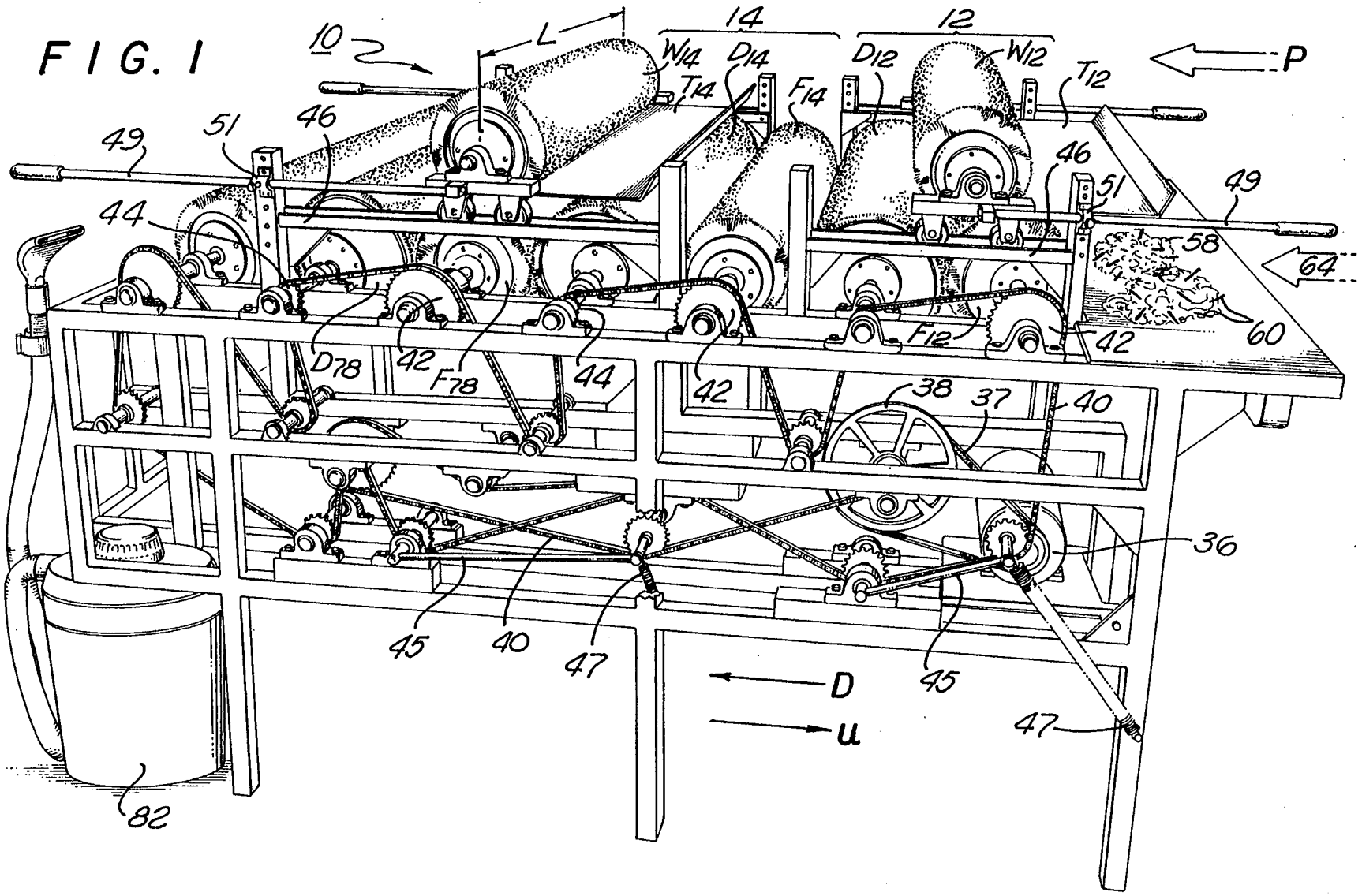
FIG. 1 is a perspective view of a dehairing system in accordance with an embodiment of the present invention.
Figure 2:
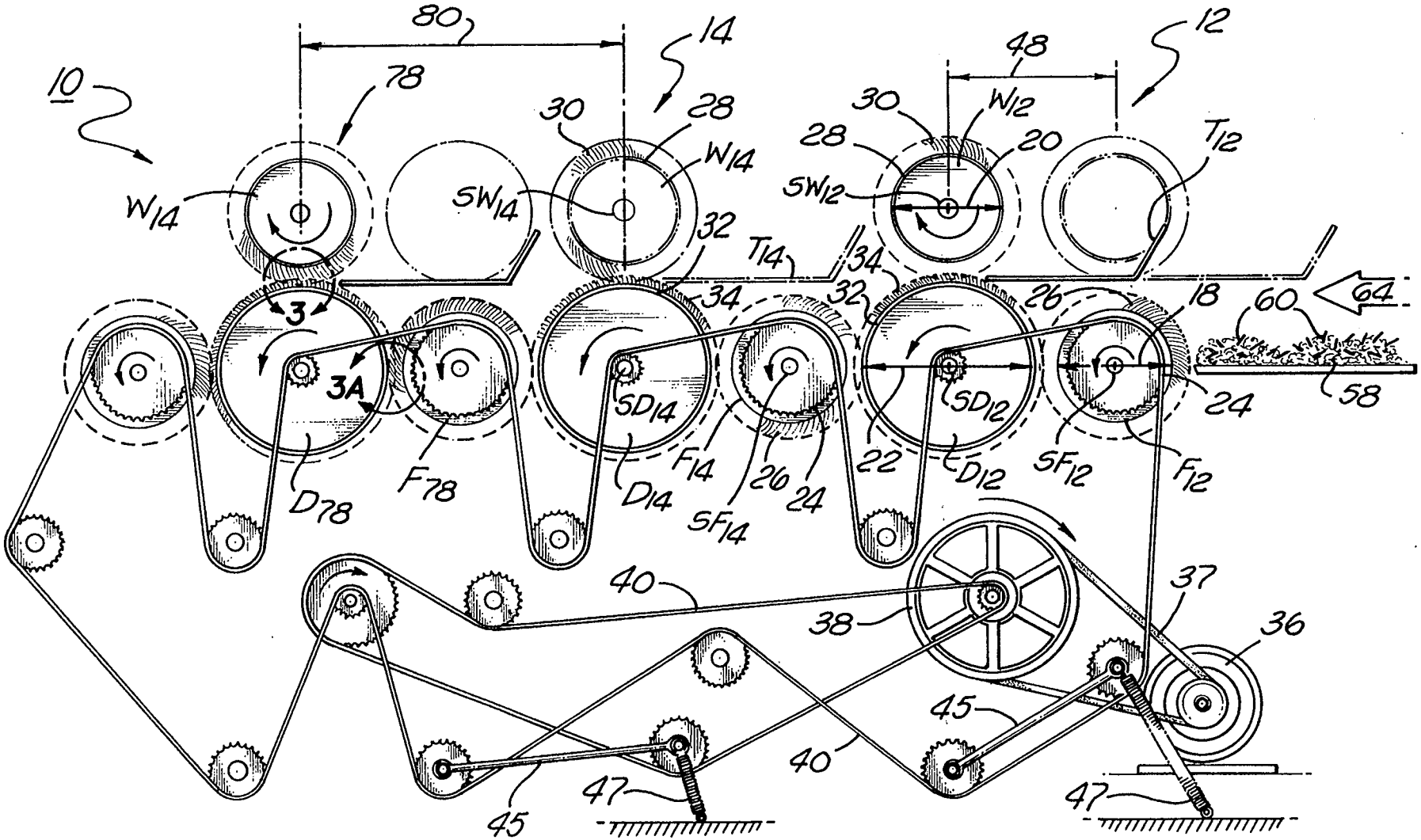
FIG. 2 is a simplified-side elevation of the dehairing system of FIG. 1.

Referring to FIGS. 1 and 2, in accordance with the present invention, a dehairing system 10 is provided for efficiently and effectively dehairing and/or cleaning wools of contaminants, including guardhairs, without substantially damaging workable fibers. The system 10 includes a dehairing unit 12 mounted on a mounting structure 16, the unit 12 having rotatable cylindrical components constructed of a durable material, such as steel, for providing tubular surfaces wrapped in cardcloth bearing tines. The components serve to transfer fibers within the unit 12 and/or to apply forces, including centrifugal force, for expelling contaminants. The components of the unit 12 include a feeder $F_{12}$, a drum $D_{12}$, and a fancy wheel $W_{12}$. The feeder $F_{12}$ is rotatably supported on a shaft $SF_{12}$; the carding drum $D_{12}$ is rotatably supported on a shaft $SD_{12}$; and the fancy wheel $W_{12}$ is rotatably supported on a shaft $SW_{12}$. The unit 12 may also include a catch tray $T_{12}$.

The embodiments of the present invention provide various dimensions within the unit 12. In one embodiment, lengths L (FIG. 1) of the components measure approximately $41\frac{1}{2}$ inches; diameters 18 and 20 (FIG. 2) of the feeder $F_{12}$ and the fancy wheel $W_{12}$, respectively, measure approximately $6\frac{1}{4}$ inches; and a diameter 22 (FIG. 2) of the drum $D_{12}$ measures approximately $10\frac{3}{8}$ inches.

Generally, the present invention provides for the components to be substantially equal in length; however, the diameters 18, 20 and 22 may measure quite differently. Essentially, the diameter 20 is of a dimension so as to enable the fancy wheel $W_{12}$ to apply forces, including centrifugal force, for expelling contaminants, and the diameters 18 and 22 of the feeder $F_{12}$ and the drum $D_{12}$ are of dimensions to facilitate dehairing by the fancy wheel $W_{12}$.

As mentioned, the components of the unit 12 are wrapped in cardcloth bearing tines, as of steel or like resilient material, for creating a brushing and/or flicking action between rotating components. As shown in FIG. 2, the feeder $F_{12}$ is wrapped in a cardcloth 24 bearing tines 26; the fancy wheel $W_{12}$ is wrapped in a cardcloth 28 bearing tines 30; and the drum $D_{12}$ is wrapped in a cardcloth 32 bearing tines 34.

In one embodiment, the cardcloths 24 and 28 have tine densities of approximately 36 tines per square inch where the tines 26 and 30 have a length of approximately $1\frac{1}{4}$ inches and a thickness of approximately 1/64th of an inch. In contrast, the cardcloth 32 has a tine density of approximately 90 tines per square inch where the tines 34 have a length of approximately three-eighths of an inch and a thickness of approximately 1/64th of an inch.

Generally, the present invention provides for all of the cardcloths to have tine densities and tine lengths sufficient for transferring fibers between the components. However, the present invention further provides for the cardcloth 28 to have a tine density and a tine length sufficient for retaining workable fibers in, and/or flicking contaminants out of the system 10 during operation.

Figure 3:
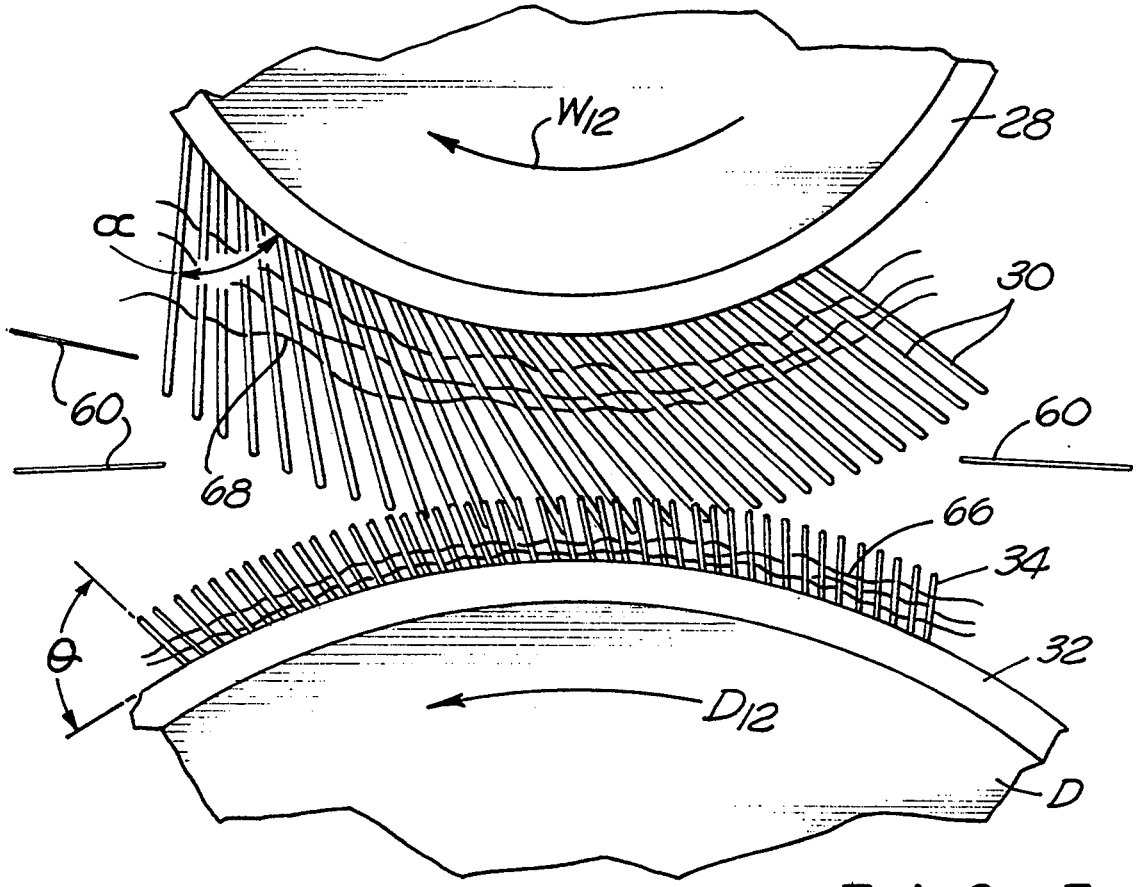
FIGS. 3 and 3A are enlarged sectional views of components of a dehairing system in accordance with an embodiment of the present invention.
Figure 3A:
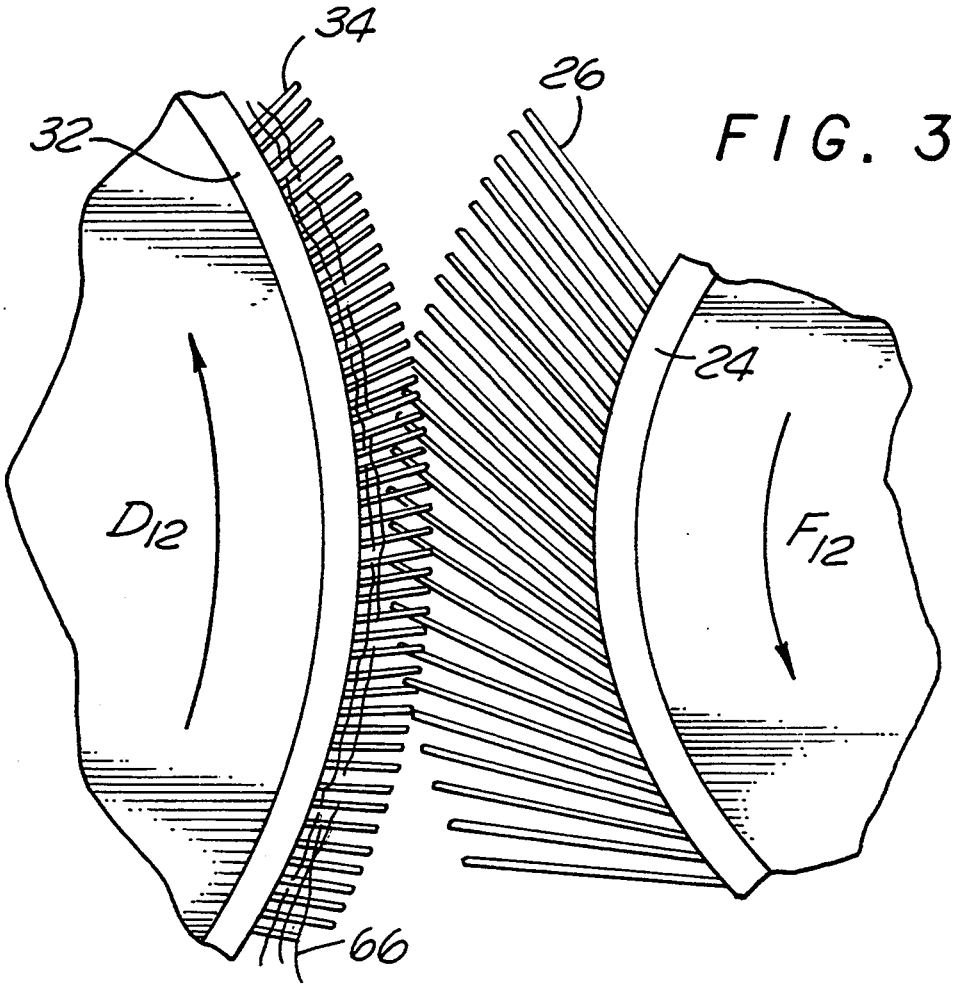

Referring to FIGS. 3 and 3A, the tines 26 and 30 of the feeder $F_{12}$ and the fancy wheel $W_{12}$ extend at an angle $\alpha$ (though measured from opposite directions) from the cardcloths 24 and 28, respectively, and the tines 34 of the drum $D_{12}$ extend at an angle $\Theta$ from the cardcloth 32. For example, the angle $\alpha$ measures substantially 45 degrees and the angle $\Theta$ measures substantially 80 degrees. Generally, the present invention provides for the tines to extend at angles facilitating dehairing, including transferring, retaining and/or flicking as described herein, while avoiding substantial damage to or scuffing of the components when rotating.

Referring back to FIGS. 1 and 2, the cylindrical components of the unit 12 do not simply rotate about their respective shafts, but rotate cooperatively, at different, as well as varying, rotational speeds to dehair. With regard to accomplishing cooperative rotation, the system 10 may incorporate various well-known electrical and/or mechanical techniques, including a driving system for directly driving the feeder $F_{12}$, the drum $D_{12}$ and the fancy wheel $W_{12}$, for example, see FIG. 1B. However, in the embodiment shown in FIGS. 1 and 2, a motor unit 36 is provided for driving only the feeder $F_{12}$ and the drum $D_{12}$. Specifically, a belt 37 couples the motor unit 36 to a pulley 38 for driving various chains 40 and gears 42 and 44. Various tensioning mechanisms, such as idler arms 45 with springs 47, are provided to vary the tension on the chains 40. As shown, the motor unit 36 rotates both the feeder $F_{12}$ and the drum $D_{12}$ in one direction (e.g., counterclockwise).

For rotating the fancy wheel $W_{12}$, the system 10 imparts rotation from the drum $D_{12}$ (as driven by the motor unit 36) to drive the fancy wheel $W_{12}$. To this end, the system 10 enables the fancy wheel $W_{12}$ to tangentially contact the drum $D_{12}$ for the drum $D_{12}$ to impart rotation. As discussed in detail further below, the tines 30 and 34 of the fancy wheel $W_{12}$ and the drum $D_{12}$ enable the drum $D_{12}$ to impart rotation. Being rotated by tangential contact with the drum $D_{12}$, the fancy wheel $W_{12}$ is rotated in an opposite direction from that of the drum $D_{12}$ (e.g., a clockwise direction). Note that where the diameter 20 (FIG. 2) of the fancy wheel $W_{12}$ is substantially less than the diameter 22 (FIG. 2) of the drum $D_{12}$, the fancy wheel $W_{12}$ is rotated by the drum $D_{12}$ at angular or rotational speeds substantially higher or faster than that of the drum $D_{12}$.

With regards to accomplishing different rotational speeds in accordance with the present invention, the system 10 may incorporate various well-known electrical and/or mechanical techniques. In the embodiment shown in FIGS. 1 and 2, the system 10 uses the gears 42 and 44 to accomplish different rotational speeds between the feeder $F_{12}$ and the drum $D_{12}$. Specifically, the system 10 uses the larger gears 42 for rotating the feeder $F_{12}$ at relatively low or slow rotational speeds and the smaller gears 44 for rotating the drum $D_{12}$ at relatively high or fast rotational speeds. For example, the feeder $F_{12}$ rotates at approximately 150 rpm, while the drum rotates at approximately 250 rpm. Generally, the present invention provides for the feeder $F_{12}$ and the drum $D_{12}$ to rotate at different speeds such that they effectively transfer fibers between each other to facilitate dehairing by the fancy wheel $W_{12}$.

With regards to accomplishing varying rotational speeds in accordance with the present invention, the system 10 may incorporate various well-known electrical and/or mechanical techniques. In the embodiment shown in FIGS. 1 and 2, where the system 10 utilizes imparted rotation for rotating the fancy wheel $W_{12}$, the system 10 enables the drum $D_{12}$ to varyingly impart rotation for accomplishing varying rotational speeds in the fancy wheel $W_{12}$. Specifically, the system 10 enables the fancy wheel $W_{12}$ to move in and out of tangential contact with the drum $D_{12}$ to vary the rotational speed of the fancy wheel $W_{12}$. As explained later in detail, by varying the degree to which the tines 30 and 34 overlap during tangential contact between the fancy wheel $W_{12}$ and the drum $D_{12}$, the fancy wheel $W_{12}$ is rotated at varying rotational speeds.

Although there exists numerous well-known techniques for accomplishing cooperative rotation, different rotational speeds, and varying rotational speeds in the unit 12, the embodiments disclosed herein enable the system 10 to operate efficiently, with less wear and tear.

Referring specifically now to FIGS. 2, 3 and 3A, the components of the unit 12 are arranged to facilitate tangential contact between the feeder $F_{12}$ and the drum $D_{12}$, and between the drum $D_{12}$ and the fancy wheel $W_{12}$. Where the components are in tangential contact and rotating, their tines overlap. Moreover, as selected components approach and leave tangential contact, the overlap between the tines varies in degree, that is, the overlap increases as the selected components approach tangential contact, and decreases as the selected components leave tangential contact.

Where the tines overlap, a flicking and/or brushing action is created between the rotating components to facilitate dehairing. As the selected components move in and out of tangential contact, the intensity of the brushing varies. Namely, the brushing intensity increases as the components approach tangential contact and decreases as components leave tangential contact. While the brushing action essentially facilitates the transfer of fibers between the components, the brushing action also enables the selected components to impart rotation.

In that respect, the brushing action is essential in the embodiment of the present invention where the drum $D_{12}$ imparts rotation to rotate the fancy wheel $W_{12}$. As the brushing intensity between the fancy wheel $W_{12}$ and the drum $D_{12}$ increases, the drum $D_{12}$ imparts more rotation, increasing the rotational speed of the fancy wheel $W_{12}$. And vice versa, as the brushing intensity between the fancy wheel $W_{12}$ and the drum $D_{12}$ decreases, the drum $D_{12}$ imparts less rotation, decreasing the rotational speed of the fancy wheel $W_{12}$.

In view of the above, it is clear that the degree of tine overlap, the brushing intensity, and the amount of rotation imparted are all interrelated to accomplish varying rotational speed in the system 10. Since varying rotational speed is required of the fancy wheel $W_{12}$, the selected components that are moved in and out of tangential contact are the fancy wheel $W_{12}$ and the drum $D_{12}$. Since varying rotational speed is not required of the feeder $F_{12}$, the feeder $F_{12}$ and the drum $D_{12}$ may remain in tangential contact throughout the operation of the system 10. It is appropriate to note here that where the embodiment of the present invention provides for direct rotation of the fancy wheel $W_{12}$ (see, e.g., FIG. 1B), the fancy wheel $W_{12}$ may remain in tangential contact with the drum $D_{12}$ through the operation of the system 10.

As clearly shown in FIG. 2, the system 10 enables the fancy wheel $W_{12}$ to migrate within the unit 12 between a contact position (solid lines) and a noncontact position (broken lines). As such, the tines 20 and 22 of the fancy wheel $W_{12}$ and the drum $D_{12}$ may intermittently overlap, and to varying degrees, during the operation of the unit 12.

As the fancy wheel $W_{12}$ migrates between the contact and noncontact positions, the degree of overlap between the tines 20 and 22 ranges between a maximum (where the fancy wheel $W_{12}$ is in the contact position), and a minimum (where the fancy wheel $W_{12}$ is in the noncontact position). Where the overlap approaches or equals the maximum (FIG. 3), the fancy wheel $W_{12}$ is rotated at relatively higher speeds, e.g., 500 rpm. Where the overlap approaches or equals the minimum, the fancy wheel $W_{12}$ is rotated at lesser speeds.

At such relatively higher speeds, the fancy wheel $W_{12}$ centrifugally expels contaminants from fibers collected on the tines 30. At such relatively lesser speeds, the fancy wheel $W_{12}$ transfers the fibers back and forth to the drum $D_{12}$. Although the range of the degree of overlap in absolute measurement is relatively minimal with respect to the size of the components, as illustrated in FIG. 3, the slightest change in the degree of overlap effectively accomplishes essential variance in the rotational speed of the fancy wheel $W_{12}$. In addition to centrifugally expelling contaminants collected on the fancy wheel $W_{12}$, the fancy wheel $W_{12}$ may flick off or otherwise directly expel contaminants collected on the tines 34 of the drum $D_{12}$. This flicking action is facilitated by the tines 30 and 34, and the difference in the angles $\alpha$ and $\Theta$.

As indicated, the shafts $SF_{12}$ and $SD_{12}$ are provided to rotatably support the feeder $F_{12}$ and the drum $D_{12}$. Because neither the feeder $F_{12}$ nor the drum $D_{12}$ requires varying rotational speed, the shafts $SF_{12}$ and $SD_{12}$ may be rotatably fixed onto the mounting structure 16. As such, the degree of overlap between the tines 26 and 34, and the brushing intensity therebetween remains substantially constant.

In contrast, varying rotational speed is required of the fancy wheel $W_{12}$, and thus, to vary the degree of overlap and consequently, the brushing intensity, the fancy wheel $W_{12}$ is enabled to migrate between the contact and the noncontact positions. As mentioned, the system 10 may incorporate various mechanical and/or electrical structures to accomplish this migration. In one embodiment, the shaft $SW_{12}$ is rotatably supported on tracks 46 (FIG. 1) positioned above and extending substantially parallel with the mounting structure 16. In this embodiment, the shaft $SW_{12}$ and the fancy wheel $W_{12}$ are slidable along the tracks 46 such that the fancy wheel $W_{12}$ is pushed/pulled by handles 49 in and out of contact with the drum $D_{12}$, as indicated by an arrow 48. To maintain the fancy wheel $W_{12}$ at a particular position with respect to the drum $D_{12}$, fastening devices, such as brackets 51, may be provided on the tracks 46 to temporarily fasten the handles 49. In another embodiment illustrated in FIG. 1A, the shaft $SW_{12}$ may be rotatably supported on a swing arm 50 fixed to the mounting structure 16. In this embodiment, the shaft $SW_{12}$ and the fancy wheel $W_{12}$ are lifted and lowered in and out of contact with the drum $D_{12}$, as indicated by an arrow 52.

In either embodiment, the rotational speed of the fancy wheel $W_{12}$ increases as the fancy wheel $W_{12}$ approaches the contact position and decreases as the fancy wheel $W_{12}$ approaches the noncontact position. In either embodiment, the fancy wheel $W_{12}$ may be manually moved (that is, by manually pushing/pulling or lifting/lowering) between the contact and noncontact positions. However, the system 10 may incorporate various mechanical and/or electrical linkages with control operations provided by a control unit to automate the migration of the fancy wheel $W_{12}$. Whether by manual or automated techniques, the system 10 enables the rotational or angular speed of the fancy wheel $W_{12}$ to vary for dehairing, including transferring, accumulating, and/or retaining fibers for centrifugal dehairing.

In operation, fibers 58 containing contaminants, such as guardhairs 60, are fed to the unit 12 as indicated by the arrow 64 on the right hand side. The feeder $F_{12}$ collects the fibers 58 and transfers the fibers 58 to the drum $D_{12}$. As the tines 26 and 34 overlap to create the brushing action (FIG. 3A), the drum $D_{12}$ collects and accumulates the fibers 58, forming a batt or web 66.

Where the fancy wheel $W_{12}$ is in contact with the drum $D_{12}$ (FIG. 3), the fancy wheel $W_{12}$ is rotating at higher speeds and collects the fibers 58 from the batt 66 on the drum $D_{12}$ and forms a batt 68. As the fancy wheel $W_{12}$ rotates at relatively higher speeds, the guardhairs 60 are expelled from the batt 68 by centrifugal force, while workable fibers are retained on the tines 30. While the fancy wheel $W_{12}$ is initially collecting the fibers 58, the fancy wheel $W_{12}$ may also flick or expel the guardhairs 60 directly from the batt 66 on the drum $D_{12}$. Most of the expelled contaminants are caught by the catch-tray $T_{12}$. (FIGS. 1 and 2) to prevent recontamination of the system 10.

Referring again to FIGS. 1 and 2, the system 10 further includes a unit 14 substantially similar in structure and function to the unit 12, and positioned adjacent the unit 12 on the mounting structure 16. So positioned, the units 12 and 14 form a dehairing processing line P defining a downstream direction D and an upstream direction U.

The components of the unit 14 include a feeder $F_{14}$, a drum $D_{14}$, and a fancy wheel $W_{14}$. The feeder $F_{14}$ is rotatably supported on a shaft $SF_{14}$; the drum $D_{14}$ is rotatably supported on a shaft $SD_{14}$; and the fancy wheel $W_{14}$ is rotatably supported on a shaft $SW_{14}$. The unit 14 may also include a catch tray $T_{14}$, as shown in FIG. 1.

Functionally similar to the unit 12, the motor unit 36 and the gears 42 and 44 rotate the feeder $F_{14}$ in a counterclockwise direction at relatively low speeds and the drum $D_{14}$ in a counterclockwise direction at relatively high speeds. The fancy wheel $W_{14}$, when in contact with the drum $D_{14}$, is rotated by the drum $D_{12}$ in a clockwise at relatively higher speeds.

Recognizing that the unit 14 is substantially similar to the unit 12, like elements between the two units are referenced with like numerals. However, differences between the units 12 and 14 exists and are substantially as discussed further below.

As described, the unit 14 is positioned downstream from the unit 12 on the mounting structure 16. The unit 14 is positioned adjacent the unit 12 such that the feeder $F_{14}$ is in tangential contact with the drum $D_{12}$ of the unit 12 for receiving the fibers 58.

Accordingly, for extended dehairing, the batt 68 collected on the fancy wheel $W_{12}$ is transferred downstream, from the unit 12 to the unit 14. First, the fancy wheel $W_{12}$ is slowly moved from the contact position to the noncontact position so that is substantially loses the batt 68 and the fibers 58 are recollected on the drum $D_{12}$ from the fancy wheel $W_{12}$. As the overlap between the tines 30 and 34 decreases, the rotational speed of the fancy wheel $W_{12}$ decreases, and the drum $D_{12}$ reaccumulates the fibers 58 from the fancy wheel $W_{12}$, reforming the batt 66.

With the batt 66 reformed on the drum $D_{12}$, the unit 12 transfers the fibers 58 to the unit 14. The feeder $F_{14}$, being in tangential contact with the drum $D_{12}$ collects the fibers 58 and transfers it to the drum $D_{14}$. The drum $D_{14}$ accumulates the fibers 58 on the tines 34, and the brushing action created by the tines 26 and 34 forms a batt 70 (not shown) on the drum $D_{14}$.

As the batt 70 forms on the drum $D_{14}$, the fancy wheel $W_{14}$ is slowly moved into contact with the drum $D_{14}$ to slowly increase the rotational speed of the fancy wheel $W_{14}$ to speeds substantially higher than that of the drum $D_{14}$. As its rotational speed increases, the fancy wheel $W_{14}$ accumulates the fibers 58 on the tines 30, while initially flicking or expelling additional guardhairs 60 directly from the batt 70 on the drum $D_{14}$. As the fancy wheel $W_{14}$ forms a web 72 (not shown), the fancy wheel $W_{12}$ expels additional guardhairs 60. A catchtray $T_{14}$ catches most of these guardhairs 60 to prevent recontamination of the system 10.

It is noted that as the fancy wheel $W_{14}$ of the unit 14 is slowly moved towards its contact position, the fancy wheel $W_{12}$ of the unit 12 is slowly moved towards its noncontact position in a substantially synchronous manner. Accordingly, the fancy wheel $W_{14}$ accomplishes extended dehairing of the fibers 58 previously dehaired by the fancy wheel $W_{12}$.

For further extended dehairing, the fibers 58 may be retransferred upstream from the unit 14 to the unit 12. Again, the fibers 58 must be recollected on the drum $D_{14}$ by decreasing the rotational speed of the fancy wheel $W_{14}$. To slowly decrease the rotational speed, the fancy wheel $W_{14}$ is slowly moved from its contact position towards its noncontact position. As the rotational speed of the fancy wheel $W_{14}$ decreases, the fancy wheel $W_{14}$ loses the batt 72 and the drum $D_{14}$ reaccumulates the fibers 58, reforming the batt 70. The feeder $F_{14}$ then retransfers the fibers 58 back to the unit 12.

Cooperatively interacting with the feeder $F_{14}$, the drum $D_{12}$ of the unit 12 reaccumulates the fibers 58, reforming the batt 66. As the fancy wheel $W_{12}$ is slowly returned to its contact position whereupon the rotational speed of the fancy wheel $W_{12}$ slowly increases, the fancy wheel $W_{12}$ reaccumulates the fibers 58 to reform the batt 68. The fancy wheel $W_{12}$ once again flicks contaminants directly off the drum $D_{12}$ and as the batt 68 reforms on the fancy wheel $W_{12}$, more guardhairs are expelled by centrifugal force.

It is again noted that as the fancy wheel $W_{12}$ of the unit 12 is slowly moved towards its contact position, the fancy wheel $W_{14}$ of the unit 14 is slowly moved towards its noncontact position in a substantially synchronous manner.

Recognizing that changes in the rotational speed facilitate the fancy wheels $W_{12}$ and $W_{14}$ transferring and accumulating the fibers 58 for dehairing, the system 10 enables the fancy wheels $W_{12}$ and $W_{14}$ to increase and decrease their rotational speeds. Furthermore, by alternately moving the fancy wheels $W_{12}$ and $W_{14}$ in and out of contact with the drums $D_{12}$ and $D_{14}$, respectively, the system 10 transfers the fibers 58 upstream and downstream the process line P for extended dehairing by forces, including centrifugal force. The fibers 58 travel between the components, as well as between the units, for repeated dehairing as desired.

As opposed to transferring the fibers 58 only between the units 12 and 14, the dehairing process line P may be extended by an additional unit 78. Like the units 12 and 14, the unit 78 has a feeder $F_{78}$ and a drum $D_{78}$, both rotated by the motor unit 36 and the gears 42 and 44 in a counterclockwise direction, with the feeder $F_{78}$ rotating at relatively low speeds and the drum $D_{78}$ at relatively high speeds. A fancy wheel $W_{78}$ (not shown) is rotated in a clockwise direction at relatively higher speeds when placed in tangential contact with the drum $D_{78}$.

With the unit 78 positioned such that the feeder $F_{78}$ is in tangential contact with the drum $D_{14}$, the fibers 58 are transferred further downstream from the unit 14 to the unit 78 in substantially the manner described above for transferring the fibers 58 downstream from the unit 12 to the unit 14. Generally, as the fancy wheel $W_{78}$ is slowly moved toward its contact position with the drum $D_{78}$, the fancy wheel $W_{14}$ is synchronously slowly moved toward its noncontact position.

After dehairing on the fancy wheel $W_{78}$, the fibers 58 may be transferred upstream to either of the units 12 or 14 for yet further extended dehairing. In this respect, the system 10 alternately moves the selected fancy wheels that are respectively transferring and receiving the fibers for dehairing. As such, for example, where the fibers 58 are to be transferred back to the unit 12, rather than the unit 14, from the unit 78 the fancy wheel $W_{12}$ is slowly moved back to its contact position for receiving the fibers 58 as the fancy wheel $W_{78}$ is slowly moved to its noncontact position. To that end, the fibers 58 substantially travel through the unit 14, bypassing the fancy wheel $W_{14}$, to be received by the unit 12.

Although the above described embodiment provides for the fancy wheel $W_{78}$ in the unit 78, another embodiment provides for the fancy wheel $W_{14}$ to substitute for the fancy wheel $W_{78}$ where needed. As shown in FIGS. 1 and 2, the system 10 enables the fancy wheel $W_{14}$ to move along the tracks 46, as indicated by an arrow 80. The fancy wheel $W_{14}$ migrates between the units 14 and 78 and in and out of tangential contact with either the drum $D_{14}$ or the drum $D_{78}$.

Figure 1A:
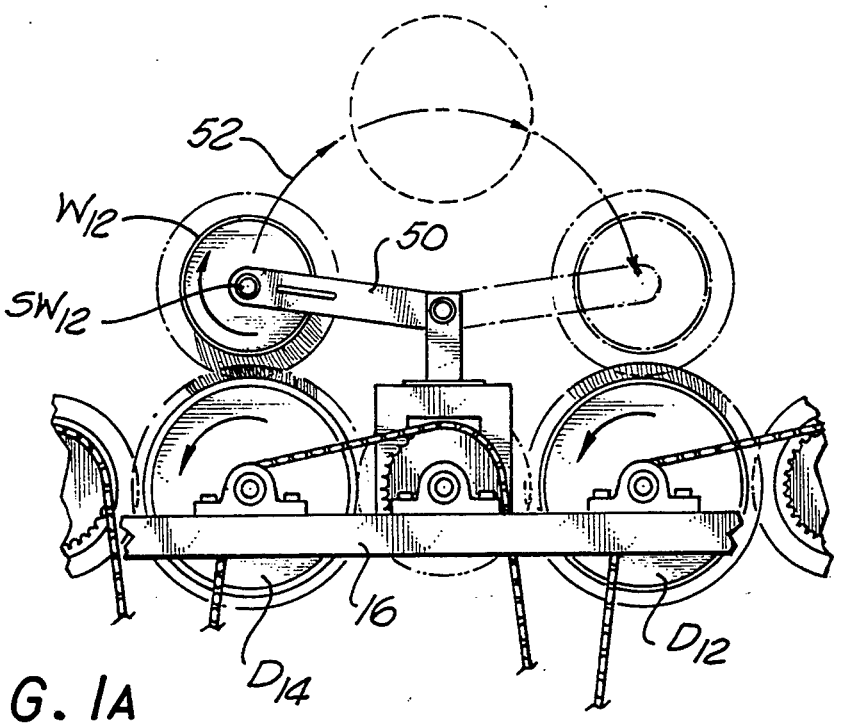
FIG. 1A is a fragmentary side elevation of a dehairing system in accordance with another embodiment of the present invention.

Also as shown in FIG. 1A, where the fancy wheel $W_{12}$ is supported on the swing arm 50, the fancy wheel $W_{12}$ may substitute for the fancy wheel $W_{14}$, migrating between the units 12 and 14 along the accurate path indicated by the arrow 52. The swing arm 50 enables the fancy wheel $W_{12}$ to move in and out of tangential contact with either the drum $D_{14}$ or the drum $D_{12}$.

Where the fibers 58 have been substantially dehaired by travelling upstream and downstream the process line P, a vacuum apparatus 82 may be provided, as shown in FIG. 1, for removing the dehaired batts 68 and/or 72 from the fancy wheels $W_{12}$, $W_{14}$ and/or $W_{78}$. Where the fibers 58 are particularly long in length, the dehaired batts collected on the drums $D_{12}$, $D_{14}$, and/or $D_{78}$ may also be removed by the vacuum apparatus 82. Removal of the dehaired batts, of course, may also be accomplished by other methods and/or apparatus, including combing and a variety of manual techniques.

Figure 1B:
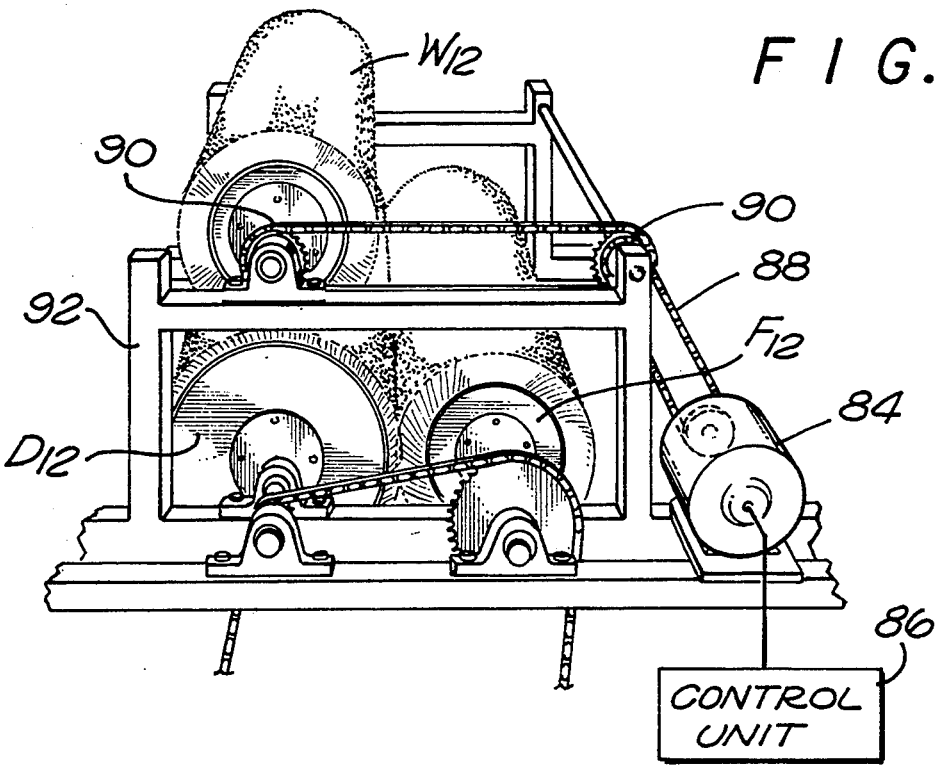
FIG. 1B is a fragmentary perspective view of an alternative embodiment in accordance with the present invention.

In accordance with the present invention, contaminants, including guardhairs, are expelled by forces including centrifugal force. Whereas dehairing by one unit is substantially accomplished by a fancy wheel rotating at varying rotational speeds for expelling contaminants, extended dehairing by the system is substantially accomplished by multiple fancy wheels alternately rotating at varying rotational speeds for transferring the fibers upstream and downstream the dehairing process line. To that end, as presented, the present invention utilizes different rotational speeds for enabling the feeders and the drums to transfer fibers upstream and downstream, and varying rotational speeds for enabling the fancy wheels to expel contaminants. Accordingly, moving the fancy wheels in and out of contact with the drums is but one way for the system 10 to accomplish varying rotational speeds. Reiterating, additional motors and/or gears may be incorporated in the system to accomplish varying rotational speeds. For example, as illustrated in FIG. 1B, the system 10 may incorporate a second motor unit 84 for rotating the fancy wheels $W_{12}$ and $W_{14}$ (not shown), and for varying the rotational speeds thereof. The second motor unit 84 may be coupled to the fancy wheels $W_{12}$ and $W_{14}$ by chains 88 and gears 90, with control operations provided by a control unit 86 to vary the rotational speed of the fancy wheels. Since in this particular embodiment, the fancy wheel $W_{12}$ need not migrate in and out of tangential contact with the drum $D_{12}$, the shaft $SW_{12}$ rotatably supporting the fancy wheel $W_{12}$ may simply be rotatably mounted onto supports 92.

Since centrifugal force of an object is defined by the equation $F_c=mrw^2$, where m=mass of the object, r=radius of the object, and w=angular velocity or rotational speed of the object, the structure and operation of the components within the system 10 may involved different angular velocities or rotational speeds, as well as different diameters or radiuses, from those embodiments discussed herein, for expelling the contaminants, particularly, guardhairs, for dehairing.

The system 10 as shown in the drawings is not necessarily to scale. That is, the components may vary in size to the extent discussed above. Moreover, the system 10 may include as many dehairing units as desired to lengthen or shorten the dehairing process line P. Accordingly, from the above explanation, it may be seen that the system of the present invention may be readily incorporated in various embodiments to provide workable fibers substantially free of contaminants. Of course, various alternative techniques may be employed departing from those disclosed and suggested herein.

What is claimed is:

1. A dehairing unit for dehairing fibers to provide workable fibers substantially free of guardhairs, comprising:

a drum rotating in one direction to transfer said fibers within said unit;

a feeder positioned in tangential contact with said drum and rotating in said one direction to feed said fibers into said unit;

a fancy wheel positioned also in tangential contact with said drum and rotatable at a rotational speed in an opposite direction; and means for varying said rotational speed of said fancy wheel for moving said fancy wheel in and out of tangential contact with said drum to provide a minimum speed allowing transfer of said fibers between said fancy wheel said drum and a maximum speed for centrifugally expelling said guardhairs.

2. A dehairing unit in accordance with claim 1 wherein a diameter of said fancy wheel measures substantially less than a diameter of said drum.

3. A dehairing unit in accordance with claim 1 where tines on said fancy wheel are substantially longer than tines on said drum.

4. A dehairing unit in accordance with claim 1 where said fancy wheel and said drum provide tines and said fancy wheel has a tine density less than a tine density of said drum.

5. A dehairing unit in accordance with claim 1 where tines on said fancy wheel and said drum extend substantially in a first direction and tines on said feeder extend substantially in a second direction.

6. A dehairing unit for dehairing fibers to provide workable fibers substantially free of guardhairs, comprising:

a drum rotatably supported on a drum shaft, said drum rotating in one direction to transfer said fibers within said unit;

a feeder rotatably supported on a feeder shaft and positioned in tangential contact with said drum, said feeder rotating in said one direction to feed said fibers into said unit;

a fancy wheel rotatably supported on a fancy wheel shaft, said fancy wheel rotatable at a rotational speed in an opposite direction, said fancy wheel shaft being movably supported on a support structure for moving said fancy wheel in and out of tangential contact with said drum for varying said rotational speed between a minimum speed allowing transfer of said fibers between said fancy wheel and said drum and a maximum speed for centrifugally expelling said guardhairs from said fibers.

7. A dehairing unit in accordance with claim 6 where said support structure includes tracks extending linearly in a direction substantially perpendicular to said shafts.

8. A dehairing unit in accordance with claim 6 where tines on said fancy wheel extend at a first angle and tines on said drum extend at a second angle.

9. A dehairing unit in accordance with claim 6 where tines on said fancy wheel are substantially longer than tines on said drum.

10. A dehairing system for dehairing fibers to provide workable fibers substantially free of guardhairs, comprising:

an upstream unit and a downstream unit, each of said units having a first cylinder tangentially related to a second cylinder, and a third cylinder also tangentially related to said second cylinder, said upstream unit and said downstream unit positioned adjacent such that said first cylinder of said downstream unit is also tangentially related to said second cylinder of said upstream unit for forming a dehairing process line;

a first means for rotating said first and second cylinders in one direction; and a second means for rotating said third cylinders in an opposite direction between a minimum rotational speed allowing transfer of said fibers between said units and a maximum rotational speed for centrifugally expelling said guardhairs from said fibers; said second means including means for moving said third cylinders between contact and noncontact positions with said second cylinders, respectively.

11. A dehairing system in accordance with claim 10 where said second means for rotating substantially alternately increases and decreases rotational speeds of said third cylinders.

12. A dehairing system in accordance with claim 11, where said first means for rotating rotates said first and second cylinders in one direction and said second means for rotating rotates said third cylinders in an opposite direction.

13. A dehairing system in accordance with claim 11, where said cylinders bear tines and said tines of said smaller cylinders are substantially longer than said tines of said larger cylinders.

14. A dehairing system in accordance with claim 10, further comprising:

a mounting structure supporting said upstream and downstream units, said cylinders being rotatably supported on said mounting structure.

15. A dehairing system in accordance with claim 10 where said first means for rotating includes a motor unit for driving said first and second cylinders.

16. A dehairing system in accordance with claim 15 where said second means for rotating includes a second motor unit for driving said third cylinders.

17. A dehairing system in accordance with claim 10, where said means for moving alternately moves each of said third cylinders between said contact and noncontact positions.

18. A dehairing system in accordance with claim 17, where said tines on said third cylinders are substantially longer than said tines on said second cylinders.

19. A dehairing unit in accordance with claim 10 where tines on said fancy wheel extend at a first angle and tines on said drum extend at a second angle.

20. A dehairing unit in accordance with claim 10 where tines on said fancy wheel are substantially longer than tines on said drum.

21. A process for dehairing fibers of a type naturally containing guardhairs by using a dehairing unit having a first, a second, and a third cylinders to provide workable fibers substantially free of said guardhairs, said process comprising the steps of:

rotating said first cylinder in one direction for feeding fibers into said unit;

rotating said second cylinder in said one direction allowing transfer of fibers within said unit, said second cylinder being in tangential contact with said first cylinder;

moving said third cylinder in and out of tangential contact with said second cylinder; and rotating said third cylinder at a rotational speed for centrifugally expelling said guardhairs from said fibers, said third cylinder rotating in an opposite direction.

22. A process for dehairing in accordance with claim 21 where a first rotational speed of said first cylinder is lesser than a second rotational speed of said second cylinder.

23. A dehairing process in accordance with claim 21, where said step of moving said third cylinder varies said rotational speed of said third cylinder to allow transfer of said fibers between said third cylinder and said second cylinder.

24. A dehairing process in accordance with claim 21, where said step of moving said third cylinder comprises the step of moving said third cylinder into an idle position and a contact position with said second cylinder.

* * * * *

UNITED STATES PATENT AND TRADEMARK OFFICE

CERTIFICATE OF CORRECTION

PATENT NO. : 5,446,945
DATED : September 5, 1995
INVENTOR(S) : Steven C. Hachenberger It is certified that error appears in the above-indentified patent and that said Letters Patent is hereby corrected as shown below:

Column 6, line 46, no period after $T_{12}$;

Column 6, line 68, after "clockwise" insert --direction--;

Column 7, line 4, change "exists" to --exist--;

Column 7, line 15, after "that" insert --it--;

Column 9, lines 47-48, change "involved" to --involve--; and

Column 12, line 12, change "cylinders" to --cylinder--.

Signed and Sealed this

Ninth Day of January, 1996

*Attest:*

Bruce Lehman

BRUCE LEHMAN

*Attesting Officer*

*Commissioner of Patents and Trademarks*